United States Patent [19]

Ahroni

[11] Patent Number: 4,807,098

[45] Date of Patent: Feb. 21, 1989

[54] LAMPHOLDERS FOR MINIATURE LIGHT SETS

[76] Inventor: Joseph M. Ahroni, 2701 W. Mano Pl., #204, Seattle, Wash. 98199

[21] Appl. No.: 131,027

[22] Filed: Dec. 10, 1987

Related U.S. Application Data

[63] Continuation-in-part of Ser. No. 945,602, Dec. 22, 1986, which is a continuation-in-part of Ser. No. 664,153, Oct. 24, 1984, Pat. No. 4,631,650.

[51] Int. Cl.[4] ..... F21V 21/00

[52] U.S. Cl. ..... 362/249; 362/806; 174/114 R; 313/51; 315/288; 439/419

[58] Field of Search ..... 174/113 R, 114 R, 114 S, 174/117 F; 313/1, 51, 250, 251, 267, 268, 272, 285; 315/288; 362/227, 236, 237, 238, 249, 252, 806; 439/387, 391, 414, 417, 419, 425, 492, 505, 658, 659, 699

[56] References Cited

U.S. PATENT DOCUMENTS

| | | | |
|---|---|---|---|
| 1,974,472 | 9/1934 | Seghers | 362/249 X |
| 3,005,177 | 10/1961 | Wieckmann | 439/419 |
| 3,609,643 | 9/1971 | Connan | 439/419 |
| 4,631,650 | 12/1986 | Ahroni | 362/249 |

*Primary Examiner*—Stephen F. Husar
*Attorney, Agent, or Firm*—Seed and Berry

[57] ABSTRACT

A lampholder for miniature light sets has a socket at one end to receive a lamp unit and a wireway at the opposite end which is covered by a snap-on cover. The socket receives two identical contact plates which are laterally reversible so that in one position they project by a respective insulation severing element into one portion of the wireway to engage a first wire, and in a second position the severing element projects into a second portion of the wireway to engage a second wire.

10 Claims, 2 Drawing Sheets

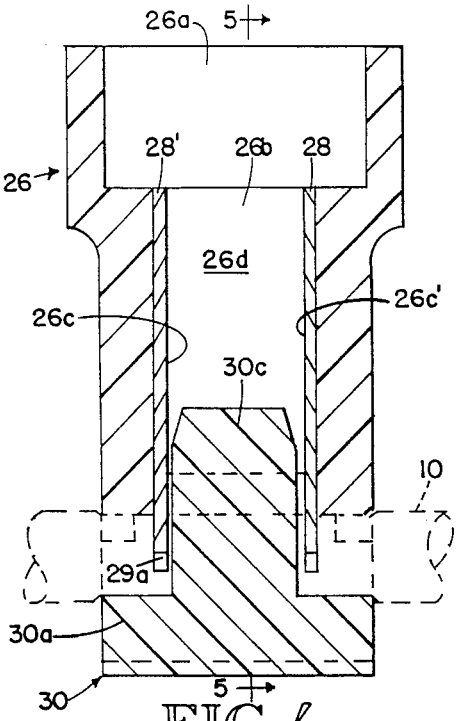
FIG. 4
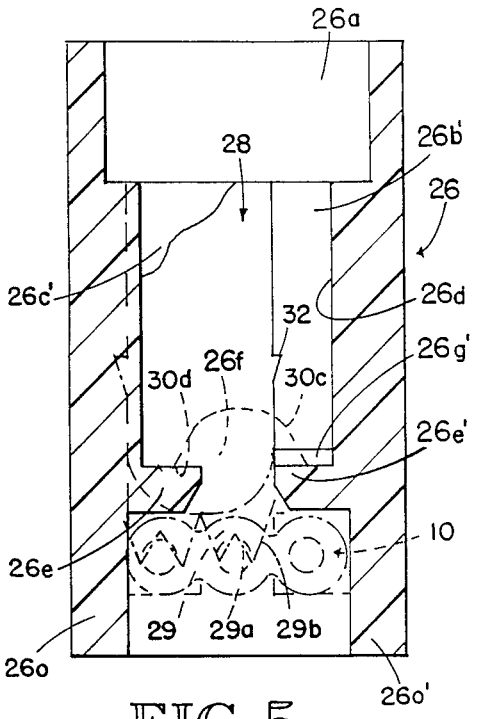
FIG. 5
FIG. 6
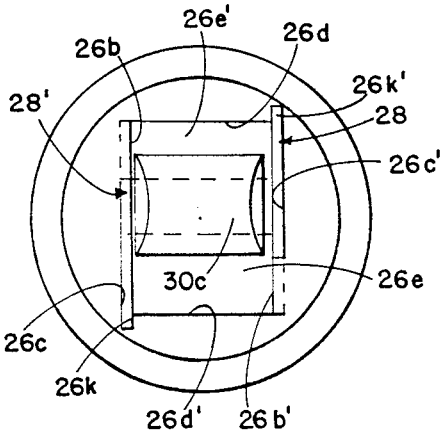
FIG. 7
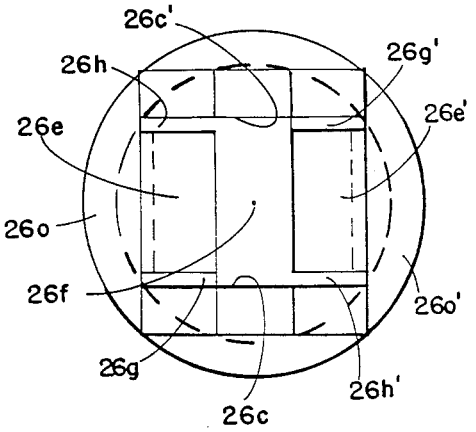

LAMPHOLDERS FOR MINIATURE LIGHT SETS

RELATED APPLICATIONS

This application is a continuation-in-part of my copending application Ser. No. 945,602, filed Dec. 22, 1986, which is in turn a continuation-in-part of my application Ser. No. 664,153, filed Oct. 24, 1984, now U.S. Pat. No. 4,631,650.

TECHNICAL FIELD

The present invention relates to lampholders for series-parallel strings of lights, and particularly to those having miniature push-in type bulbs operating at relatively low voltage.

BACKGROUND ART

Decorative light strings in which all of the bulbs are in a single series have the disadvantage that if one bulb fails to light, the entire string goes out and it may be difficult to determine which light failed. Also, in a series string, the voltage available for each light is the line voltage divided by the number of bulbs. If, on the other hand, all the bulbs are in a parallel arrangement, failure of one of the bulbs does not affect the others, but each bulb is subjected to the full line voltage unless a transformer is used.

A suitable compromise between a series lighting circuit and a parallel lighting circuit is one in which sets of series-arranged bulbs are wired in parallel relation to make up a string. This is called a "seriesparallel" string. In such a string, the voltage for each light is the line voltage divided by the number of bulbs in each set. If a bulb fails in a series-parallel string, only the bulbs in the series set containing that bulb will fail to light. Hence, there are fewer bulbs to check to find the faulty bulb than in a string where all the bulbs are in a single series string.

Normally, in a series-parallel string of miniature push-in type bulbs, the lampholders in each series set are interconnected by using multiple short lengths of insulated lead wire connected to contact plates in a manner similar to that shown, for example, in U.S. Pat. No. 3,104,924. The lead wires to and from the first and last lampholders in each series set are connected, respectively, to parallel wires from the wall plug. Alternatively, the connection to the parallel wires is made by interrupting the parallel wires at the first and last bulbs of each series set and connecting both interrupted ends to the appropriate contact plate of the first and last lampholders. Hence, assembly of a series-parallel string of miniature lights has involved the handling and end-stripping of many pieces of wire, and normally there has been a need to wind the series wires and the parallel wires together between the bulbs for ease of handling when applying the string to a Christmas tree.

DISCLOSURE OF THE INVENTION

The present invention provides an improved lampholder and insulated three-strand cord, making it unnecessary to use multiple short lengths of wire and making it possible to make both contact elements in the lampholder identical, thus making it more economical and faster to assemble a string.

In carrying out the invention, lampholder housings are provided with a snap-on cover at their base end which provides a wireway with the rest of the housing. Two identical contact plates in each lampholder have insulation-severing contact elements projecting into the wireway to pierce the insulation of the cord and make the proper electrical connection to the wire. The cord has three side-by-side wires separated by insulation, the outer two wires being the parallel wires of the circuit and the center wire providing the series connection wires. The center wire is preformed with cutouts for the lampholder locations. The lampholder covers have cover-fastening means passing through the respective cutout to separate the ends of the center wire exposed at the cutout as well as securing the cover in place.

Each contact plate has an insulation-piercing element to engage the center wire and make a series connection via the bulb across the cutout in the center wire. As part of the present invention, each of the contact plates is laterally reversible so as to alternatively position its piercing element in engagement with the center wire or one of the other two wires in the cord. Thus the lead-in contact plate can be reversed in the first lampholder in each series set and the lead-out contact plate of the last lampholder in each series set may be reversed to engage the appropriate one of the outer parallel wires so as to make the parallel connection for the series set.

BRIEF DESCRIPTION OF THE DRAWINGS

FIG. 4 is a longitudinal sectional view of the lampholder with the cover in place and taken as indicated by line 4—4 in FIG. 3.

FIG. 5 is a longitudinal sectional view of the lampholder taken as indicated by line 5—5 of FIG. 4, but with the cover shown in phantom and with the alternative position of the illustrated contact plate shown in phantom.

FIG. 6 is a top plan view of the lampholder with the cover in operative position.

FIG. 7 is a bottom plan view of the lampholder housing before insertion of the conductor plate elements.

BEST MODE FOR CARRYING OUT THE INVENTION

Figure 2:
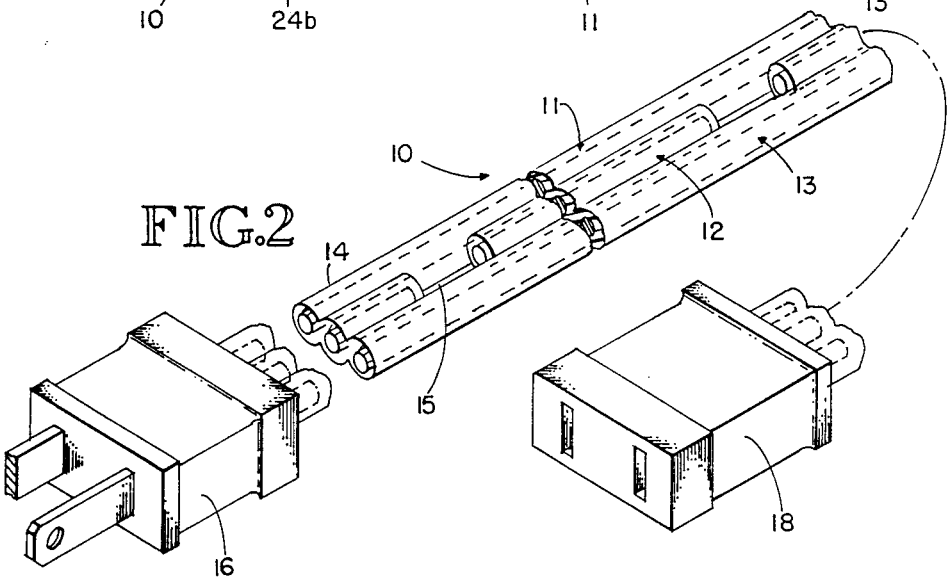
FIG. 2 is an isometric view showing a power cord with cutouts used with the present invention.

As shown in FIG. 2, there is provided an insulated cord 10 having three wires 11, 12, and 13 arranged in generally coplanar relation as a ribbon and separated by insulation 14. The cord 10 has a series of cutouts 15 severing and passing through the center wire 12 and spaced apart along the length of the cord according to the desired spacing of the lampholders. At its ends, the cord 10 is provided with a wall plug 16 and an add-on socket 18. The outer two wires 11, 13 are electrically connected to the two contacts of the plug 16 and socket 18, and the center wire 12 dead-ends within the plug and socket.

Each lamp unit of the invention has a miniature push-in type lamp assembly comprising a bulb 20 and a lamp base 22 in which the lamp 20 is mounted, and has a lampholder unit 24 receiving the lamp base. The lampholder unit 24 has a husk or housing 26, two identical brass contact plates 28–28', and a cover 30.

As is common in the decorative lighting string art, each lamp 20 seats in a circular socket **22*a*** in the lamp base 22. The latter is necked beneath the socket 22*a* and has an extension 22*b* with a generally rectangular cross section which tapers at the outer end to assist in entry into the lampholder housing 26. The lamps 20 have a pair of wire leads 20*a* extending therefrom. These leads 20*a* extend from the circular socket portion 22*a* of the lamp base 22 through respective longitudinal passages in the extension 22*b* and double back over opposite faces 22*c* of the extension.

The lampholder housing 26 has a cylindrical socket portion 26*a* to receive the socket portion 22*a* of the lamp base 22, and has a generally rectangular bore extension 26*b*. This bore extension has the wider two of its opposite sides formed with a laterally stepped configuration to provide recessed faces 26*c*, 26*c*', each extending about two-thirds of the wider width of the bore extension 26*b*. Significantly, the recessed faces 26*c*, 26*c*' extend laterally in opposite directions so that only about half of the width of each of the recessed faces is positioned directly opposite the other.

The narrower faces 26*d*, 26*d*' of the bore extension 26*b* extend longitudinally from the socket portion 26*a* to a pair of opposed, cantilevered base flanges 26*e*, 26*e*' of generally rectangular configuration in plan view which are separated by a base entry 26*f*. At one of their ends, the base flanges 26*e*, 26*e*' are separated from the rest of the body of the housing 26 by slots 26*g*, 26*g*' which terminate shortly above the base flanges, as seen in FIG. 5. At their other ends, the base flanges 26*e*, 26*e*' are separated from the rest of the body of the housing 26 by slots 26*h*, 26*h*' which continue laterally from the recesses providing the bore extension faces 26*c*, 26*c*'. Preferably, the recesses providing the bore extension faces 26*c*, 26*c*' are extended laterally outward as longitudinal keeper grooves 26*k*, 26*k*', best seen in FIG. 6.

The base entry 26*f* connects the bore extension 26*b* with a wireway 26*m* that is also intersected by the slots 26*h*, 26*h*' and the keeper grooves 26*k*, 26*k*'. The longitudinal sides of the wireway 26*m* are defined by opposed housing base extensions 26o, 26o' which have a height adequate to laterally confine the cord 10 and the cover 30.

The cover 30 has a rectangular base 30*a* of a size to fit between the housing base extensions 26o, 26o' and cover the underside of the wireway. At its upper side, the cover 30 has a central projecting divider leg 30*b* formed with a tapered keeper head 30*c*. This head is formed with a pair of keeper faces 30*d* at opposite sides for engaging the upper faces of the base flanges 26*e*, 26*e*', as shown in phantom in FIG. 5. The housing 26 and cover 30 are injection-molded plastic selected to have sufficient resiliency to permit the keeper head 30*c* to snap-fit into position responsive to pushing through the entry 26*f* between the flanges 26*e*, 26*e*' As shown in FIG. 5, the mouth of the entry 26*f* is preferably tapered along the opposed longitudinal edges of the flanges 26*e*, 26*e*'.

Figure 3:
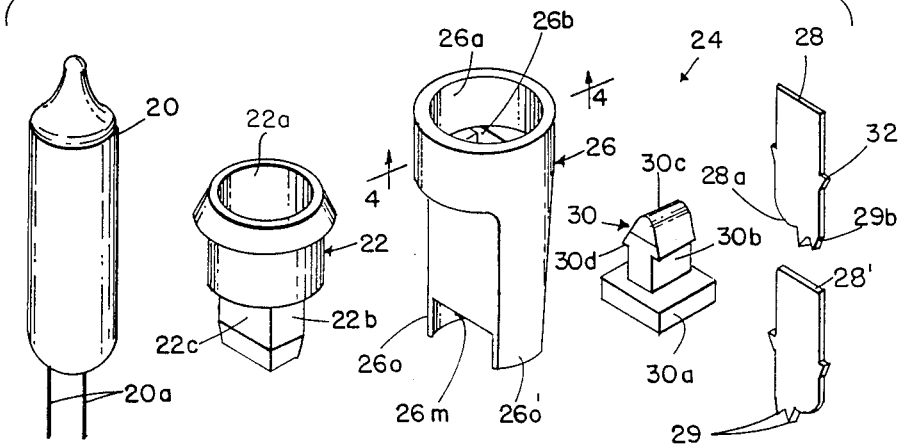
FIG. 3 is an exploded isometric view of a lamp unit of the present invention for use in the light string of FIG. 1.

Referring to FIGS. 3 and 5, the contact plates 28, 28' each have a pair of tapered fingers 29 which have opposed insulation-severing edges 29*a* and function as contact elements. These fingers 29 are adapted to pierce the insulation around a wire until the wire nests at the narrow end of the tapered slot between the fingers so that contact is made between the fingers and the wire, as indicated in FIG. 5 with respect to the center wire 12 shown in phantom. The contact plates 28, 28' are inserted through the cylindrical socket portion 26*a* of the housing in alignment with the slots 26*h*, 26*h*' so that the outer faces of the contact members will rest against the recessed faces 26*c*, 26*c*' and the outer longitudinal edge portions of the contact members will fit within the keeper grooves 26*k*, 26*k*'. When the upper edges of the contact members are flush with the upper ends of the recessed faces 26*c*, 26*c*', the tapered contact fingers 29 project into the wireway. The contact members have tapered barbs 32 to resist movement thereof out of the bore extension 26*b* by biting into the adjoining housing material.

When assembling the light string, the covers 30 may be positioned with the divider legs 30*b* passing through the cutouts 15 in the cord 10. Then the covers and cord can be positioned in the wireways of the housings 26 between the housing base extensions 26o, 26o', whereupon the covers and housings can be pressed together to give them a snap-fit. This pressure also forces the contact fingers 29 through the cord insulation 14 into wire contact so that a circuit will be completed to the leads 20*a* of the lamps 20.

Figure 1:
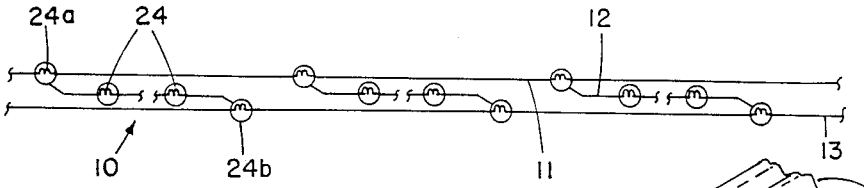
FIG. 1 is a schematic drawing of a series-parallel light string which is achieved using the present invention.

As indicated in FIG. 1, multiple sets of the lampholders 24 are placed in series with respect to center wire 12 between the parallel wires 11, 13. All of the lampholders 24 in each series set, except lampholders 24*a*, 24*b* at the two ends of the series set, have the contact plates 28, 28' arranged with their contact fingers 29 directly opposite one another so as to make contact with the center wire 12 on opposite sides of the cutouts 15. The end lampholders 24*a*, 24*b* have only one of the contact plates 28, 28' positioned so that its contact elements will make contact with the center wire 12. Each end lampholder 24*a* has one of the contact plates laterally reversed from its normal position so that its contact fingers 29 are arranged to make contact with wire 11, and each end lampholder 24*b* has one of its contact plates laterally reversed in the opposite direction so that its contact fingers 29 will make contact with wire 13. It will be apparent that the end lampholders 24*a*, 24*b* in each series section can be identical to the other lampholders, the only difference being the lateral reversal of one of the contact plates.

To assist in case of entry of the contact plates 28, 28' into the lampholder housing 26, it is preferred to round the entry end at the lead-in corner that is spaced from the tapered contact fingers 29. The resulting rounded edge 28*a* is complemented by the taper of the outer edge 29*b* of the outermost finger in guiding the contact plates into position in the housing 26 during assembly. In this regard, the contact plates 28 are adapted to be nested like staples loaded in a magazine and spring fed for dispensing into the lampholders, by a pressure element, thus making assembly easier and more economical.

Although it is preferred to use a pair of tapered fingers as the contact element for the contact plates 28, it will be appreciated that a single tapered contact element can be used which is centered over the wire to be contacted so as to pierce the insulation and contact the wire by its point. Also, although a snap cover is preferred so that all of the assembly work can be conducted independently of the plastic molding operation for making the lampholder housing and cover, the contact plates 28 are also advantageous if the lampholder housing is molded onto the cord with the contact plates positioned in the die.

Although the lampholders of the present invention are illustrated as being used for a series-parallel string, it will be understood that the lampholders 24 could also be used in a series set having a two-wire cord with only wires 11 and 12. In that case the wires 11,12 would both be connected to the contacts in the plug 16 and the end lampholder remote from the plug 16 would have its contact plates 28, 28' arranged in the same manner as lampholder 24*a* and namely with the one of its contact plates closest to the nearest lampholder 24 and the other contact element engaging wire 11. In that case, the end of wire 11 in lampholder 24*a* could be covered by an extension on the housing 26 or cover 30, or covered by an independent element. The wire 12 would terminate within lampholder 24*a* of its cutout 15 therein.

From the foregoing it will be appreciated that, although specific embodiments of the invention have been described herein for purposes of illustration, various modifications may be made without deviating from the spirit and scope of the invention. Accordingly, the invention is not to be limited except as by the appended claims.

I claim:

1. A lampholder comprising:

a housing having a socket at one end to receive a lamp unit, and having a wireway at the opposite end to receive three side-by-side insulated wires occupying a central portion and first and second opposite side portions of the wireway;

said socket having two recessed portions at opposite sides thereof, one of said recessed portions intersecting said central portion and said first opposite side portion of the wireway and the other of said recessed portions intersecting said central portion and said second opposite side portion of the wireway; and a pair of like contact members lodged in respective of said recessed portions to be engaged by wire leads from said lamp unit, said contact members each having an insulation-severing contact element projecting into said wireway, each of said contact members being reversible before being lodged in said recessed portions to have its said contact element projecting either into said central portion of the wireway or into one of said opposite side portions of the wireway.

2. A lampholder according to claim 1 in which said wireway has a cover having a snap interfit with said housing.

3. A lampholder according to claim 1 in which said housing has a pair of base flanges overlying said first and second opposite side portions of the wireway and each having one of its ends adjacent one of said contact members, said base flanges being separated by an entry from the wireway into said socket; and a cover over the wireway and having a central locking member extending through said entry and having an enlarged head engaging the socket side of said base flanges.

4. A lampholder according to claim 1 in which each of said members has its said contact element centered in one lateral half thereof and projecting beyond the extent of the adjoining end of the other lateral one-half of the contact member.

5. A lampholder according to claim 4 in which said adjoining end is rounded.

6. A lampholder according to claim 1 in which the end of each contact member having said contact element is tapered for ease of insertion into said socket.

7. A lampholder comprising:

a housing having a socket at one end to receive a lamp unit, and having a wireway at the opposite end to receive three side-by-side insulated wires occupying a central portion and first and second opposite side portions of the wireway;

said socket having a generally rounded mouth portion and a generally rectangular extension portion, said extension portion having two recessed portions at opposite sides thereof intersecting said mouth portion, and one of said recessed portions intersecting said central portion and said first opposite side portion of the wireway and the other of said recessed portions intersecting said central portion and said second opposite side portion of the wireway; and a pair of like contact members lodged in respective of said recessed portions to be engaged by wire leads from said lamp unit, said contact members each having an insulation- a severing portion projecting into said wireway, each of said contact members being adapted to be introduced through said mouth portion into the respective said recessed portions and being reversible before being introduced so as to be adapted to have its insulation-piercing portion projecting either into said central portion of the wireway or into one of said opposite side portions of the wireway.

8. A lampholder according to claim 7 in which said contact members have barbs shaped to resist movement of the contact members toward said mouth portion after they are lodged in said recessed portions.

9. A lampholder according to claim 7 in which said housing has a respective retaining groove along one edge of each of said recessed portions for receiving an edge portion of the respective contact member.

10. A lampholder comprising:

a housing having a socket at one end to receive a lamp unit of the type having two exposed wire leads, and having a wireway at the opposite end to receive two side-by-side insulated wires occupying first and second portions of the wireway;

said socket having a generally rectangular portion with two of its opposite sides intersecting said first and second portions of the wireway;

a pair of like contact members lodged in said socket in engagement with said two opposite sides to be engaged by said two wire leads of said lamp unit, said contact members each being generally flat along its length for engagement by one of said wire leads and having an insulation severing element projecting at an end thereof into said wireway, each of said contact members being reversible at each of said opposite sides to have its insulation piercing portion projecting either into said first portion of the wireway or into said second portion of the wireway.

* * * * *